United States Patent [19]

Parrott

[11] 4,248,483

[45] Feb. 3, 1981

[54] END CUTTING UNIT FOR A MINING MACHINE

[75] Inventor: George A. Parrott, Wakefield, England

[73] Assignee: Dresser Europe SA, England

[21] Appl. No.: 38,710

[22] Filed: May 14, 1979

[30] Foreign Application Priority Data

May 12, 1978 [GB] United Kingdom ..... 19387/78

[51] Int. Cl.[3] ..... E21C 27/24

[52] U.S. Cl. ..... 299/53

[58] Field of Search ..... 299/42, 43, 45, 46, 299/53, 54

[56] References Cited

U.S. PATENT DOCUMENTS

| | | | |
|---|---|---|---|
| 156,339 | 10/1874 | Fletcher | 299/53 |
| 4,155,598 | 5/1979 | Parrott et al. | 299/43 |

FOREIGN PATENT DOCUMENTS

| | | | |
|---|---|---|---|
| 2357559 | 11/1973 | Fed. Rep. of Germany | 299/44 |

*Primary Examiner*—Ernest R. Purser

*Attorney, Agent, or Firm*—Larson, Taylor and Hinds

[57] ABSTRACT

An end cutting unit for a mining machine comprises a cutting unit body, a ranging arm carrying a drivable cutting device, said ranging arm being carried by the cutting unit body at a location towards a first end thereof, and a transmission for transmitting drive to the cutting device. In order that the end cutting unit may be adaptable to advance and retreat mining uses as required, transmission is provided with two drive couplings respectively at said first end and at the opposite second end of the cutting unit body to enable rotary drive to be transmitted to the cutting device from a selected one of said drive couplings, and the ranging arm is capable of being set in a position, about which the arm can be ranged, in which the arm extends generally away from the end of the cutting unit body at which is located whichever drive coupling has been selected to impart rotary drive to the cutting device.

7 Claims, 4 Drawing Figures

END CUTTING UNIT FOR A MINING MACHINE

Figure 1:
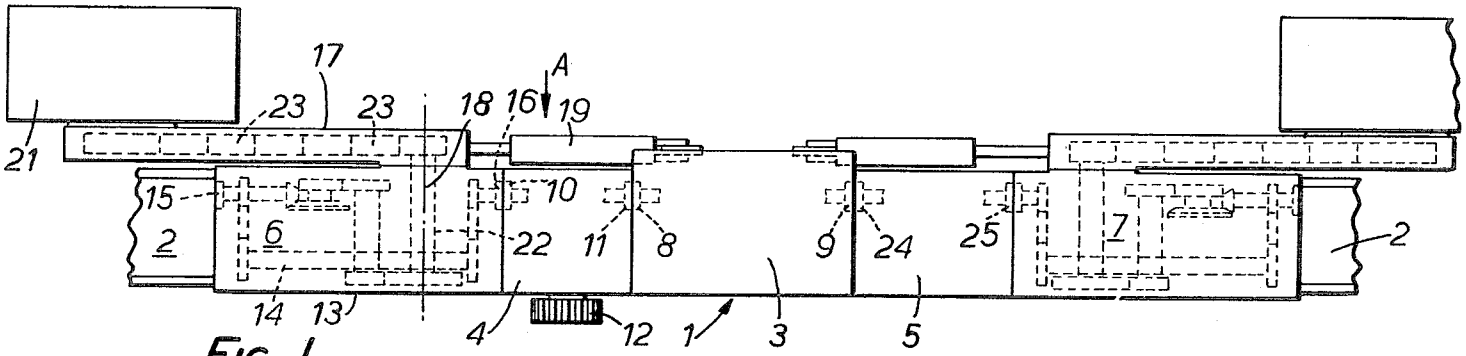

This invention relates to an end cutting unit for a mining machine.

In the known technique of retreat mining, two mine roadways are tunnelled from a mine gallery into the coal seam to be mined so as to extend in generally parallel relationship. A mining machine is advanced to the far end of one of the roadways and then, having been positioned so as to extend at right angles to the direction of the roadway, makes a cutting pass through the seam across to the other roadway. In subsequent cutting passes across the seam face, the mining machine removes successive bands of coal and mineral between the roadways until eventually all the coal and mineral between the two roadways has been removed and the mining machine has returned to the original mine gallery. Before each new cutting pass can be made, the machine has to be re-positioned by being moved a short distance in the retreat direction along the roadway while being arranged generally at right-angles to the roadway. The width of the roadway, a typical width being 14 feet, imposes a practical limitation on the length of the mining machine. For given operating requirements, there is a limit on how compact the haulage, pump box, drive and other parts of the machine can be made.

Many known mining machines employ a number of individual units (e.g. drive unit, haulage unit and one or more end cutting units) connected together. Typically an end cutting unit comprises a cutting unit body, a ranging arm carrying a drivable cutting device (e.g. cutter drum), the ranging arm being carried by the cutting unit body at a location towards one end thereof, and a transmission for transmitting drive to the cutting device from an input coupling. In many cases, the ranging arm has a long reach beyond the end of the mining machine which is then suitable for advance mining in which the machine is advanced further into the coal seam in successive cutting passes along a coal face in the mine gallery. Alternatively, the ranging arm can be given a short reach for retreat mining. However, no particular end cutting unit has facility for adaptation to the other mode of use so that different end cutting units will be required for advance and retreat mining.

According to the invention there is provided an end cutting unit for a mining machine, comprising a cutting unit body, a ranging arm carrying a drivable cutting device, said ranging arm being carried by the cutting unit body at a location towards a first end thereof, and a transmission for transmitting drive to the cutting device, said transmission being provided with two drive couplings respectively at said first end and at the opposite, second end of the cutting unit body whereby rotary drive can be transmitted to the cutting device from a selected one of said drive couplings, and the ranging arm being provided with means for enabling it to be set in a position, about which the arm can be ranged, in which the arm extends generally away from the end of the cutting unit body at which is located whichever drive coupling has been selected to impart rotary drive to the cutting device.

In one arrangement the cutting unit body is supported from below on a first set of shoes and is provided on top with a second set of shoes, so that the cutting unit body can be turned over into an upside-down disposition supported on the second set of shoes. Alternatively, the cutting unit body can be provided with means by which it is releasably mounted on an underframe, whereby it can be re-mounted on the underframe in an upside-down disposition. In either case, in a mining machine comprising a motor unit having a power take-off drive coupling at each end, a haulage drive unit including a haulage transmission having a respective drive coupling at each end of the haulage unit, and an end cutting unit as described above, all three units can be releasably connected together end-to-end with the haulage unit between the motor unit and the cutting unit, such that the motor unit is coupled to drive the cutting device of the cutting unit by way of the haulage transmission and the drive coupling of the cutting unit at said first end thereof, and in order to range the ranging arm means can be provided including at least one hydraulic ram which is connected at one end to the motor unit and at the other end to a crank on the ranging arm. Preferably, the difference in axial spacing between a laterally extending axis about which the arm can range and the two ends of the cutting unit body is equal to the length of the haulage unit such that on interchanging the positions of the haulage and motor units and remounting the cutting unit body in an upside-down disposition, the cutting unit can be releasably re-connected directly to the motor unit. This arrangement avoids the need to provide any spacer unit between the cutting end and the motor unit, or adjusting the positions of the ram end mountings, when the mining machine is adapted from a retreat mining arrangement to an advance mining arrangement. The ram can, however, be releasable from at least one of the ranging arm and the motor unit to facilitate any interchanging of the positions of the haulage and motor units and re-connection of the cutting unit to the motor unit.

In a development, starting from the modification in which the positions of the haulage and motor units are interchanged and the cutting unit releasably connected directly to the motor unit, a lump breaking unit having an input drive connection is releasably connected to the cuttng unit with the said input drive connection coupled to the drive coupling of the cutting unit at said first end thereof, the entire lump breaking unit being within the reach of the ranging arm.

Figure 2B:
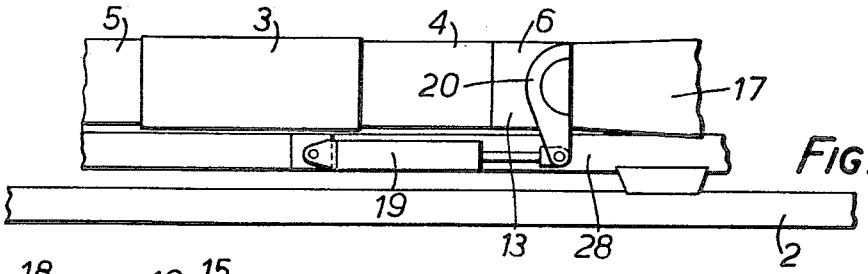
Figure 2A:
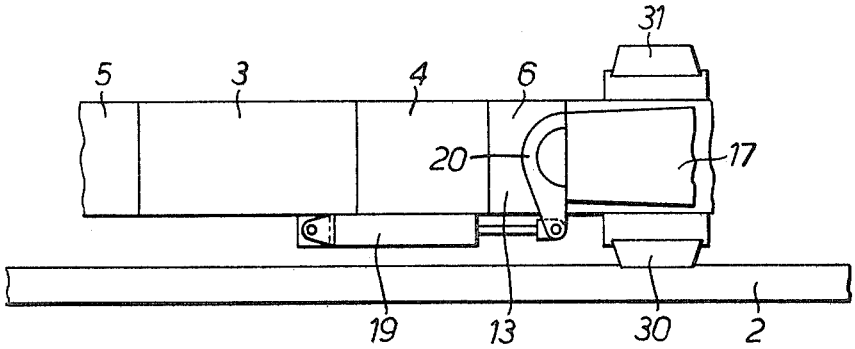

For a better understanding of the invention and to show how the same may be carried into effect, reference will now be made, by way of example, to the accompanying drawings, in which:

FIG. 1 is a plan view of a mining machine incorporating one form of end cutting unit in accordance with the present invention, adapted for retreat mining;

FIG. 2*a* is a partial side view taken in the direction of the arrow A in FIG. 1;

FIG. 2*b* is a corresponding side view of a modification; and

Figure 3:
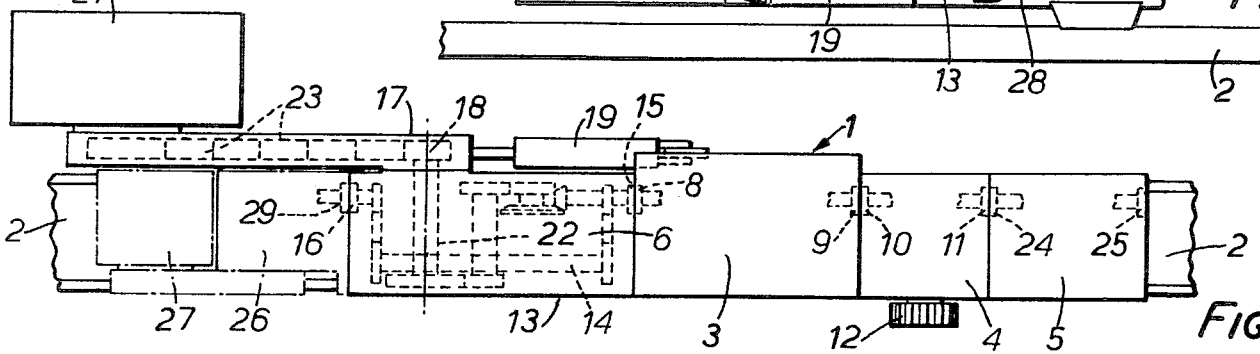

FIG. 3 is a view corresponding to FIG. 1 but showing the cutting unit adapted for advance mining.

Referring to FIGS. 1 and 2*a*, a mining machine 1 for mounting on a conveyor 2 comprises a motor unit 3, a haulage drive unit 4 at one end of the motor unit, a pump box unit 5 at the other end of the motor unit, and end cutting units 6 and 7, all the units 3 to 7 being releasably connected together (such as by bolts).

The motor unit conveniently includes an electric motor driving a transmission (not shown) having power take-off couplings 8,9 at the respective ends of the motor unit. The haulage drive unit 4 similarly includes a transmission having a drive coupling 10, 11 at each end of the unit, the coupling 11 being drivably engaged with the coupling 8 of the motor unit. The haulage transmission is coupled to drive a haulage sprocket 12 whose teeth are engaged with a haulage chain (not shown) associated with the conveyor. The cutting unit 6 comprises a cutting unit body 13 housing a transmission 14 having drive couplings 15, 16 at each end of the cutting unit body, the coupling 16 being drivably engaged with the coupling 10 of the haulage unit.

A ranging arm 17 is mounted on the cutting unit body towards that end at which the coupling 16 is provided. The arm 17 can be set in a position about which the arm can be ranged about a transverse axis 18, in which the arm extends generally away from the right-hand end of the cutting unit body in FIG. 1. As shown with reference to FIGS., 1 and 2a, a hydraulic ram 19 serves to range the arm 17 about the axis 18 acting at one end on a crank 20 releasably secured, for example by bolts, to the arm 17, the ram being connected, possibly releasably, at its other end to the motor unit 3. The ram cylinder is supplied with hydraulic fluid under pressure from a pump in the pump box unit 5, this unit including respective drive couplings 24, 25 at the two ends of the pump box unit which are connected for driving the pump.

The arm 17 drivably carries towards its free end a cutting device shown in the form of a cutting drum 21 on which cutting picks will be provided. The drive for the drum is taken-off from the transmission 14 and transmitted by way of a shaft 22, which is coaxial with the transverse axis 18, and gearing 23 in the arm itself.

The construction of the end cutting unit 7 is identical to that of the unit 6 and so will not be further described herein.

In the arrangement shown in FIGS. 1 and 2*a*, the mining machine is intended for retreat mining. In this respect, it will be noted that the arm 17 is located well away from the exposed end of the cutting unit but close to the haulage drive unit, the arm consequently having a relatively small reach beyond the exposed end of the cutting unit and the overal length of the cutting unit being in consequence reduced.

In order to adapt the machine so that the ranging arm has a long reach for advance mining, the connections between all the units of the mining machine are released, the haulage drive is positioned between the motor unit and the pump box unit, and then the end cutting unit 6 is rotated through 180 degrees about the axis 18 (so as to adopt an upside-down disposition) while keeping the arm 17 in the same position (see FIG. 3). Especially advantageously as shown in FIGS. 1 and 3, the difference between the spacings of the axis 18 from the two ends of the end cutting unit is equal to the length of the haulage drive unit 4, so that once the haulage drive unit and cutting units have been rearranged in the manner described above, all the units of the mining machine can be re-connected together without the need for, for example, a spacer unit between the cutting unit and the motor unit, or for adjusting the positions of the hydraulic ram end mountings, in order that the arm can still be ranged through the same angles. The releasable securement of the crank 20 on the arm 17, and also any releasable connection which may be provided where the ram is connected to the motor unit body, can facilitate re-assembling the units of the mining machine from the retreat mining arrangement to the advance mining arrangement. The end cutting unit 6 will generally be provided on its underside with a set of shoes 30 which run along the conveyor 2. Naturally, a further set of shoes 31 will accordingly be provided on the top of the cutting unit so that it can run on these additional shoes when the cutting unit is turned over. Optionally, the cutting unit 7 can be dispensed with altogether (as in FIG. 3) or adapted in the described manner for advance mining.

In the modification shown in FIG. 2b all the units of the mining machine are releasably mounted on an underframe 28. Then, all that is required, when adapting the end cutting unit 6 to advance mining configuration, is to remount the body 13 on the underframe in an upside-down disposition. No further set of shoes is required since the underframe 28 remains in the same position.

In the case of both embodiments described, another possibility is merely to inter change the positions of end cutting units 6,7 (without turning the cutting unit bodies over), it being merely necessary then to set the ranging arms in their required new positions.

Of course, in all cases, the positions of both end drive couplings of each end cutting unit need to be chosen to suit the intended mode of adaptation to the different mining configurations.

As shown in FIG. 3, when the units of the mining machine are connected together in an advance mining arrangement, the input drive to the cutting unit 6 is by way of the coupling 15. The coupling 16 can then be used as a power take-off coupling for powering a lump breaking unit 26 which is releasably connected to the exposed end of the cutting unit 6 and includes a breaking or crushing drum 27 whose peripheral surface is spaced away from the upper surface of the conveyor so as to define a lump breaking gap through which coal and other minerals on the conveyor 2 will pass, any lumps which are larger than the height of the lump breaking gap being crushed against the conveyor by the drum 27. Of course, as shown in FIG. 3, it is necessary that the entire lump breaking unit be within the reach of the end cutting unit.

It will be appreciated, then, that the described cutting unit is especially versatile in that by fitting it into the mining machine in the appropriate way, the mining machine can be adapted for use in advance or retreat mining. This has the advantage that a single machine can be adapted to operate in both mining modes and that only a single set of spare parts is required for the end cutting unit.

I claim:

1. An end cutting unit for a mining machine, comprising a cutting unit body, a ranging arm carrying a drivable cutting device, said ranging arm being carried by the cutting unit body at a location towards a first end of the cutting unit body, and a transmission for transmitting drive to the cutting device, said transmission being provided with two drive couplings respectively at said first end and at the opposite second end of the cutting unit body whereby rotary drive can be transmitted to the transmission and hence to the cutting device from a selected one of said drive couplings, and the ranging arm being provided with means for enabling it to be set in a position, about which the arm can be ranged, in which the arm extends generally away from the end of the cutting unit body at which is located whichever drive coupling has been selected to impart rotary drive to the cutting device.

2. An end cutting unit according to claim 1, wherein the cutting unit body is supported from below on a first set of shoes and is provided on top with a second set of shoes so that the cutting unit body can be turned over into an upside-down disposition supported on the second set of shoes.

3. An end cutting unit according to claim 1, wherein the cutting unit body is provided with means by which it is releasably mounted on an underframe, whereby it can be remounted on the underframe in an upside-down disposition.

4. A mining machine comprising a motor unit having a power taken off drive coupling at each end, a haulage drive unit including a haulage transmission having a respective drive coupling at each end of the haulage unit, and an end cutting unit according to claim 2 or 3, wherein all three units are releasably connected together end-to-end with the haulage unit between the motor unit and the cutting unit such that the motor unit is coupled to drive the cutting device of the cutting unit by way of the haulage transmission and the drive coupling of the cutting unit at said first end thereof, and, for ranging the ranging arm, means are provided including at least one hydraulic ram which is connected at one end to the motor unit and at the other end to a crank on the ranging arm.

5. A mining machine according to claim 4, wherein the difference in axial spacing between a laterally extending axis about which the arm can range and the two ends of the cutting unit body is equal to the length of the haulage unit such that on interchanging the positions of the haulage and motor units and remounting the cutting unit body in an upside-down disposition, the cutting unit can be releasably re-connected directly to the motor unit.

6. A mining machine according to claim 5, wherein the ram is releasable from at least one of the ranging arm and the motor unit to facilitate any interchanging of the positions of the haulage and motor units and re-connection of the cutting unit to the motor unit.

7. A mining machine according to claim 5 with the modification that the positions of the haulage and motor units are interchanged and the cutting unit releasably connected directly to the motor unit, wherein a lump breaking unit having an input drive connection is releasably connected to the cutting unit with the said input drive connection coupled to the drive coupling of the cutting unit at said first end thereof, the entire lump breaking unit being within the reach of the ranging arm.

* * * * *